US005564507A

United States Patent [19]

Matsushita et al.

[11] Patent Number: 5,564,507

[45] Date of Patent: Oct. 15, 1996

[54] LOAD CONTROL UNIT FOR A BULLDOZER

[75] Inventors: Shigenori Matsushita; Shu H. Zhang; Shigeru Yamamoto; Satoru Nishita; Kazushi Nakata, all of Hirakata, Japan

[73] Assignee: Kabushiki Kaisha Komatsu Seisakusho, Tokyo, Japan

[21] Appl. No.: 254,886

[22] Filed: Jun. 6, 1994

[30] Foreign Application Priority Data

Jun. 8, 1993 [JP] Japan ..... 5-137926

[51] Int. Cl.[6] ..... A01B 67/00

[52] U.S. Cl. ..... 172/3; 172/7; 364/424.07

[58] Field of Search ..... 172/2, 3, 7, 9, 172/4, 4.5; 364/424.07; 37/348, 382; 414/699

[56] References Cited

U.S. PATENT DOCUMENTS

| | | | |
|---|---|---|---|
| 4,120,364 | 10/1978 | Wooldridge | 172/2 |
| 4,157,118 | 6/1979 | Suganami et al. | 172/7 X |
| 4,211,282 | 7/1980 | Frisbee | 172/7 |
| 4,282,933 | 8/1981 | Suganami et al. | 172/7 X |
| 4,385,353 | 5/1983 | Schneider | 172/2 X |
| 4,454,919 | 6/1984 | Arnold et al. | 172/7 X |
| 4,630,685 | 12/1986 | Huck, Jr. et al. . | |
| 4,796,712 | 1/1989 | Rutkowski et al. | 172/7 |
| 5,287,280 | 2/1994 | Yamamoto et al. | 364/424.07 X |
| 5,293,944 | 3/1994 | Matsumoto | 172/2 |
| 5,297,649 | 3/1994 | Yamamoto et al. | 364/424.07 X |
| 5,333,479 | 8/1994 | Yamamoto et al. | 172/3 |

FOREIGN PATENT DOCUMENTS

| | | | |
|---|---|---|---|
| 53-6967 | 2/1978 | Japan . | |
| 53-5441 | 2/1978 | Japan . | |
| 55-36776 | 2/1980 | Japan . | |
| 63-31618 | 6/1988 | Japan . | |
| 1-62525 | 3/1989 | Japan . | |
| 3-43523 | 2/1991 | Japan . | |
| 6-3886 | 2/1994 | Japan . | |
| 9218706 | 10/1992 | WIPO | 364/424.07 |

*Primary Examiner*—Terry Lee Melius
*Assistant Examiner*—Victor Batson
*Attorney, Agent, or Firm*—Armstrong, Westerman, Hattori, McLeland & Naughton

[57] ABSTRACT

A load control unit for a bulldozer, comprising an actual tractive force detector for detecting the actual tractive force of a vehicle body; target tractive force setting switch for setting a target tractive force for an automatic blade control mode in dozing operation; and blade controller for controlling a blade to be lifted or lowered such that if there is a difference between the actual tractive force detected by the actual tractive force detector and the target tractive force set by the target tractive force setting switch when digging is started with the automatic blade control mode in dozing operation, the actual tractive force gradually comes closer to the target tractive force.

23 Claims, 10 Drawing Sheets

LOAD CONTROL UNIT FOR A BULLDOZER

BACKGROUND OF THE INVENTION (1) Field of the Invention

The present invention relates to techniques for controlling the load which is applied to the blade of a bulldozer during digging and carrying in dozing operation.

(2) Description of the Prior Art

Dozing operation by the use of a bulldozer has been previously performed in such a way that by fully manual operation of the operator who drives a bulldozer, a blade to be lifted or lowered is operated so that the load applied to the blade during digging and carrying can be kept substantially constant.

SUMMARY OF THE INVENTION

Such manual operation for lifting or lowering a blade to keep the load on the blade substantially constant for getting good efficiency has the disadvantage that it brings tremendous fatigue to the operator, even if he is very skillful, since he has to carry out lifting/lowering operation a number of times. Another disadvantage is that the above operation itself is very complicated and difficult to carry out not only for unskilled operators who soon get exhausted but also for experienced operators.

One proposal to solve the above problems would be a load control unit for a bulldozer in which the actual tractive force of the vehicle body is detected and this detected tractive force is made to be equal to a preset target tractive force, in other words, the load applied to the blade is controlled to be constant.

However, prior art load control units for a bulldozer for performing the above-described load control cannot always perform smooth load control, because the blade is likely to move abruptly when digging is started or when a driving mode (e.g., automatic digging mode or automatic carrying mode etc.) is switched to another, and because the blade is likely to work improperly due to incorrect detection of the actual tractive force, such as when gear shift is carried out by the transmission or when the steering is in operation.

The invention has been made in order to overcome the above disadvantages, and an object of the invention is therefore to provide a load control unit for a bulldozer with which load control can be smoothly performed by eliminating the abrupt moving and erroneous operation of the blade, so that not only dozing operation can be efficiently carried out by a simple operation without causing a great deal of fatigue to the operator but also smooth blade control can be ensured.

In order to accomplish the above object, a load control unit for a bulldozer according to the invention comprises:

(a) actual tractive force detector means for detecting the actual tractive force of a vehicle body;

(b) target tractive force setting means for setting a target tractive force for an automatic blade control mode in dozing operation; and (c) blade controller means for controlling a blade to be lifted or lowered such that if there is a difference between the actual tractive force detected by the actual tractive force detector means and the target tractive force set by the target tractive force setting means when digging is started with the automatic blade control mode in dozing operation, the actual tractive force gradually comes closer to the target tractive force.

According to the load control unit of the invention, when digging is started with the automatic blade control mode in dozing operation, if there is a difference between the actual tractive force detected by the actual tractive force detector means and the target tractive force which is set in accordance with soil property etc., the blade is controlled to be lifted or lowered by the blade controller means such that the actual tractive force gradually becomes equal to the target tractive force, whereby the load applied to the blade during digging or carrying can be kept constant.

With such an arrangement, if there is a difference in the actual tractive force and the target tractive force at the start of digging, the actual tractive force will be gradually and smoothly decreased or increased so as to approach to the target tractive force. This prevents the abrupt moving of the blade at the start of digging, and therefore efficient dozing operation can be performed by a simple operation without causing tremendous fatigue to the operator.

Preferably, the invention includes a driving mode switching means which performs switching between a manual operation mode and an automatic blade control mode in dozing operation. In this case, there may be provided, as the automatic blade control mode, at least an automatic digging mode associated with digging in dozing operation and an automatic carrying mode associated with carrying in dozing operation. The driving mode switching means may be a push button selector switch, a grip-type selector switch, a twisting-type selector switch or a rotary selector switch. Preferably, the blade controller means controls the blade such that when the actual tractive force at the start of digging is smaller than the target tractive force, time required for making the actual tractive force to be equal to the target tractive force is longer than that when the actual tractive force at the start of digging is greater than the target tractive force. This minimizes resistance exerted on the blade i.e., resistance exerted on the vehicle when making the actual tractive force to be equal to the target tractive force and, thus, enables smooth blade control.

According to another aspect of the invention, there is provided a load control unit for a bulldozer, comprising:

(a) actual tractive force detector means for detecting the actual tractive force of a vehicle body;

(b) target tractive force setting means for setting a target tractive force for an automatic blade control mode in dozing operation;

(c) judging means for judging whether the actual tractive force detected by the actual tractive force detector means is stable without fluctuating in relation to the target tractive force set by the target tractive force setting means; and (d) driving mode shifting means for shifting from an automatic digging mode associated with digging in dozing operation to an automatic carrying mode associated with carrying in dozing operation, if the judging means judges that the actual tractive force is in a stable state.

In the load control unit for a bulldozer according to the second aspect, switching from the automatic digging mode to the automatic carrying mode can be performed smoothly, with the actual tractive force being stable.

Preferably, the target tractive force for the automatic carrying mode is set a predetermined amount smaller than the target tractive force for the automatic digging mode. With this arrangement, when the automatic digging mode is selected with a load corresponding to a great target tractive force, a large volume of ground can be dug. On the other hand, when the automatic carrying mode is selected with a load corresponding to a small target tractive force, a small volume of ground is dug whereby a large amount of soil can be carried so that little soil is fallen down from the blade. Accordingly, efficient dozing operation can be achieved.

Preferably, shifting from the target tractive force for the automatic digging mode to the target tractive force for the automatic carrying mode is carried out gradually. This enables it to minimize resistance exerted on the vehicle body when making the actual tractive force to be equal to the target tractive force and, thus, enables smooth blade control.

According to still another aspect of the invention, there is provided a load control unit for a bulldozer, comprising:

(a) actual tractive force detector means for detecting the actual tractive force of a vehicle body;

(b) blade controller means for controlling a blade to be lifted or lowered such that, if there is a difference between the actual tractive force detected by the actual tractive force detector means and a set target tractive force, the actual tractive force becomes equal to the target tractive force;

(c) transitional state detector means for detecting whether the vehicle body is in a transitional driving state; and (d) blade holding controller means for temporarily halting the control of the blade carried out by the blade controller means in order to hold the blade in a predetermined position for a specified time from the point of time when the transitional state detector means detects a transitional driving state.

In the load control unit for a bulldozer according to the third aspect of the invention, erroneous operation of the blade can be prevented since the blade control is temporarily halted with the blade in a predetermined position during the transitional driving state where the detection of the actual tractive force by the actual tractive force detector means cannot be performed correctly.

The transitional state detector means may be (i) a convertor switched state detector means for detecting whether a torque convertor is being switched between a torque converting state in which torque transmitted between the input shaft and the output shaft of the torque convertor is converted and a locked-up state in which the torque convertor is locked up so that the above torque is not converted but directly transmitted; (ii) a speed range shifted state detector means for detecting whether shift between a first forward speed and a second forward speed is being carried out by a transmission; or (11i) steering state detector means for detecting the condition of the steering. In the above arrangement, if the convertor switched state detector means detects that the torque convertor is being switched, if the speed range shifted state detector means detects that shift between the speed ranges being carried out by the transmission, if the steering state detector means detects the operation of the steering, or if a specified time has not elapsed after the detection in each case, the blade holding controller means will control the blade to be held in a predetermined position.

Detection of the actual tractive force by the actual tractive force detector means is performed in either of the following ways.

1. An engine revolution sensor for detecting the revolution speed Ne of an engine and a torque convertor output shaft revolution sensor for detecting the revolution speed Nt of an output shaft of a torque convertor are employed. A speed ratio e (=Nt/Ne), which is the ratio of the engine revolution speed Ne detected by the engine revolution sensor to the torque convertor output shaft revolution speed Nt detected by the torque convertor output shaft revolution sensor, is first obtained. Then, torque convertor output torque is obtained from the torque convertor characteristic of the torque convertor, using the speed ratio e. The torque convertor output torque thus obtained is then multiplied basically by the reduction ratio between the output shaft of the torque convertor and sprockets for driving the crawler belts used for running the vehicle body, whereby the actual tractive force of the vehicle body is detected.

2. An engine revolution sensor for detecting the revolution speed of an engine is used, when the torque convertor equipped with a lock-up mechanism is selected to "locked up" or when a direct transmission is employed. Engine torque is obtained from the engine torque characteristic of the engine, using the revolution speed of the engine detected by the engine revolution sensor. Then, the engine torque thus obtained is multiplied basically by the reduction ratio between the engine and the sprockets for driving the crawler belts used for running the vehicle body, and accordingly, the actual tractive force of the vehicle body is detected.

The actual tractive force detector means may be equipped with a pitch angle sensor for detecting the pitch angle of the vehicle body inclining in forward and backward directions and the actual tractive force which has been detected by the detector means may be corrected in accordance with the pitch angle detected by the pitch angle sensor. This allows the load applied to the blade during digging or carrying to be maintained constant irrespective of running resistance which is dependent on the pitch angle of the vehicle body, that is, the angulation of the ground where the vehicle runs.

The control of lifting or lowering the blade by the blade controller means is not performed when the blade is in manual operation, but performed when the blade is in the automatic blade control mode and the first forward speed or second forward speed is selected. This makes it possible to perform automatic blade control only when a speed suitable for dozing operation such as the first forward speed or second forward speed is selected in the automatic blade control mode. The manual operation of the blade is carried out in preference to the automatic driving operation and, therefore, can be performed any time at will, by interposing it in the course of automatic driving.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIGS. 1 to 12 illustrate a preferred embodiment of a load control unit for a bulldozer according to the invention;

FIG. 1 is an external appearance of the bulldozer;

FIG. 2 is a skeleton diagram of a power transmission system;

FIG. 3 is a schematic block diagram of the overall construction of the load control unit;

FIGS. 5 to 8 and FIG. 12 are a graph showing a curved engine characteristic map; graph showing a pump correction characteristic map; graph showing a curved torque converter characteristic map; graph showing a pitch angle-load correction value characteristic map; and graph showing a load control characteristic map, respectively; and FIGS. 9 and 10 are graphs each showing a process in which a target tractive force is gradually changed when an automatic digging mode is selected; and FIG. 11 is a graph showing a process in which a target tractive force is gradually changed when the automatic digging mode is changed to an automatic carrying mode.

PREFERRED EMBODIMENTS OF THE INVENTION

With reference to the drawings, a load control unit for a bulldozer according to a preferred embodiment of the invention will be hereinafter described.

Figure 1:
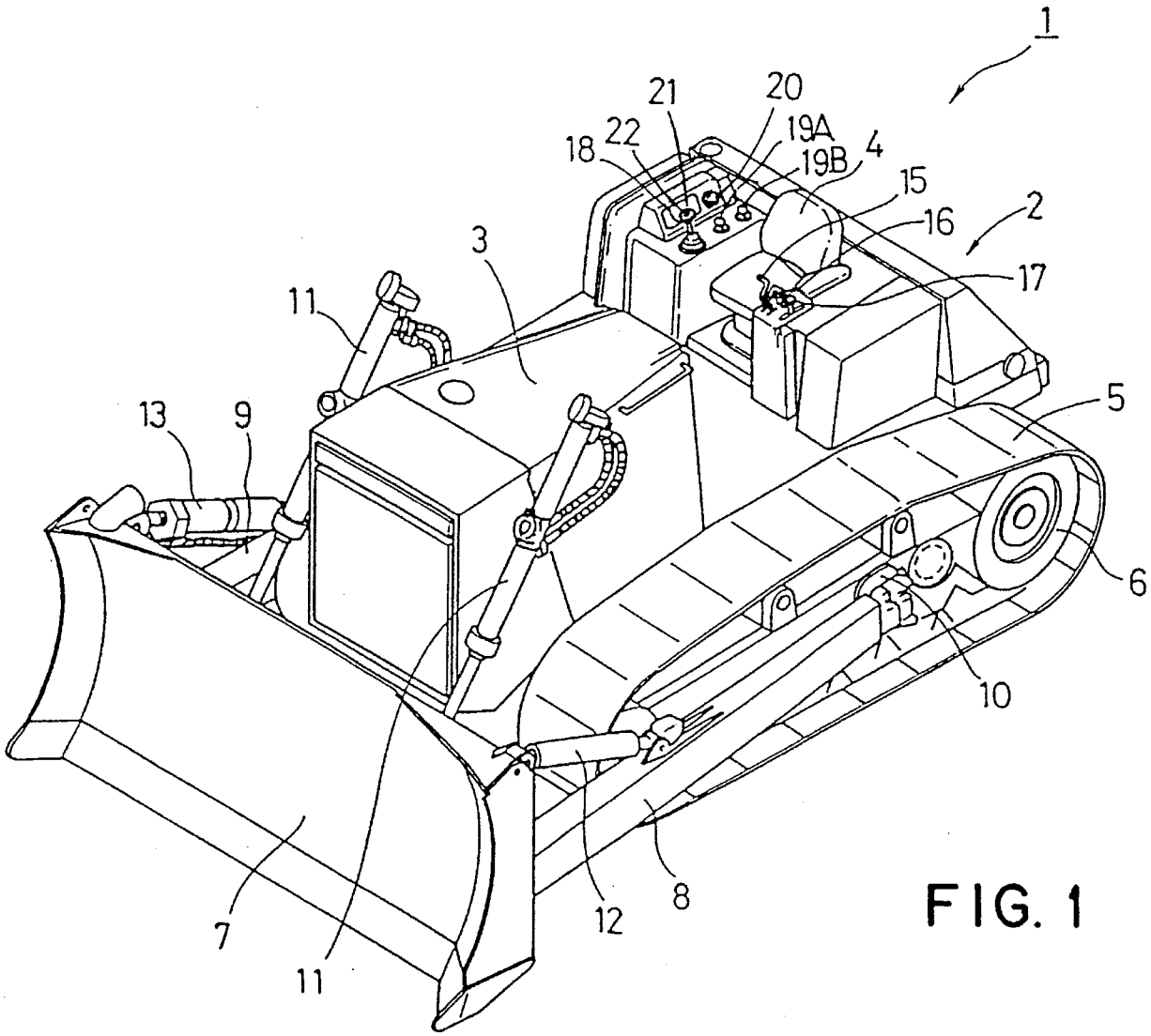

Referring to FIG. 1, there is shown the external appearance of a bulldozer 1 which is provided with, on a vehicle body 2 thereof, a bonnet 3 for housing an engine (not shown) and an operator seat 4 for the operator who drives the bulldozer 1. Both sides (i.e., the right and left sides of the vehicle body 2 when viewed in its moving direction) of the vehicle body 2 are provided with crawler belts 5 (the crawler belt on the right side is not shown) for running the vehicle body 2 so as to turn or move back and forth. Each of these crawler belts 5 are independently driven by their respective sprockets 6 actuated by driving force transmitted from the engine.

There are provided straight frames 8, 9 for supporting a blade 7 at the forward ends of the blade 7. The base ends of these right and left straight frames 8, 9 are pivotally supported at the right and left sides of the vehicle body 2 by means of trunnions 10 (the trunnion on the right side is not shown) in such a manner that the blade 7 can be lifted or lowered. Disposed between the blade 7 and the vehicle body 2 are right and left blade lift cylinders 11 forming a pair for lifting or lowering the blade 7. For functioning to incline the blade 7 to the right and left, a brace 12 is disposed between the blade 7 and the left straight frame 8 and a blade tilt cylinder 13 is disposed between the blade 7 and the right straight frame 9.

There are provided a steering lever 15, a transmission shift lever 16 and a fuel control lever 17 on the left of the operator seat 4 when the vehicle body 2 is viewed in its moving direction. On the right of the operator seat 4, there are provided a blade control lever 18 for lifting, lowering the blade 7 and inclining it to the right and left; a first dial switch 19A for setting a load to be applied to the blade 7 and a second dial switch 19B for correcting the set load by adding or subtracting a correction value; and a lock-up selector switch 20 for brining a torque convertor into a locked-up state or releasing the torque convertor from the locked-up state; and a display unit 21. At the top of the blade control lever 18, a driving mode selector button 22 for switching driving modes in dozing operation and so on is provided. According to how many times the driving mode selector button 22 is pressed, the driving mode sequentially switches between a manual operation mode, an automatic digging mode or an automatic carrying mode in dozing operation. Although they are not shown in the drawing, a brake pedal and a decelerator pedal are disposed in front of the operator seat 4.

Figure 2:
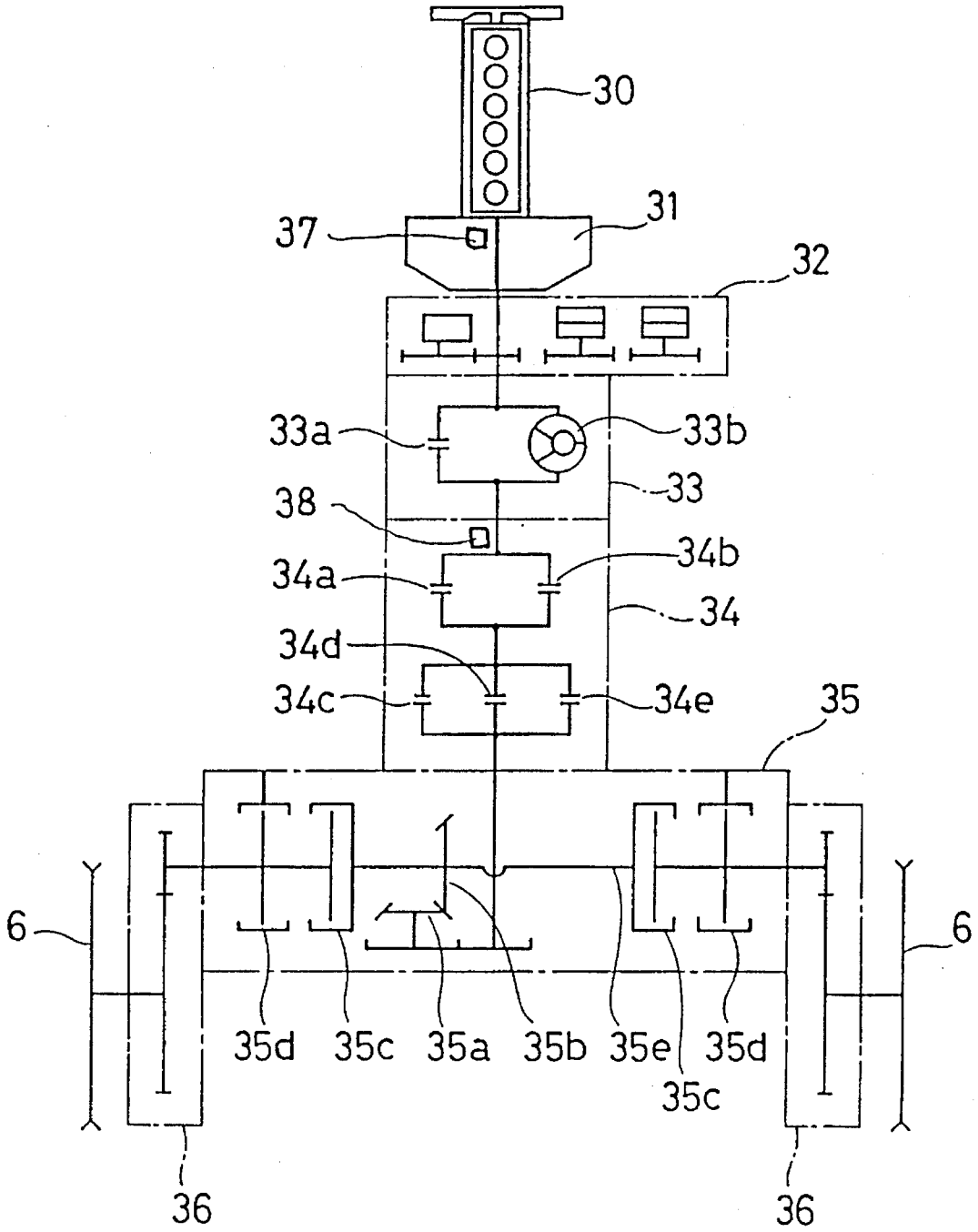

Referring to FIG. 2 which shows a power transmission system, rotary driving force from an engine 30 is transmitted to a torque convertor with a lock-up mechanism 33 through a damper 31 and a PTO 32. The torque convertor with a lock-up mechanism 33 includes a lock-up mechanism 33*a* and a pump 33*b*, and the PTO 32 functions to drive various hydraulic pumps including hydraulic pumps for operational machines. The rotary driving force is then transmitted from an output shaft of the torque convertor with a lock-up mechanism 33 to a transmission 34 such as, for example, a planetary gear lubricated multiple-disc clutch transmission, an input shaft of which is connected to the above output shaft. The transmission 34 includes forward and reverse clutches 34*a*, 34*b* and first to third clutches 34*c* to 34*e* so that the revolution of the output shaft of the transmission 34 can be shifted in three ranges in both forward and backward directions. The rotary driving force from the output shaft of the transmission 34 is transmitted to a steering mechanism 35 that includes a pinion 35 and a transverse shaft 35*e* on which disposed are a bevel gear 35*b*, right and left steering clutches 35*c* forming a pair, and right and left steering brakes 35*d* forming a pair. Thereafter, the rotary driving force is transmitted to a pair of final reduction mechanisms 36 disposed on the right and left hands so that each of the sprockets 6 for running the crawler belts 5 is driven. Reference numeral 37 denotes an engine revolution sensor for detecting the revolution speed of the engine 30 and reference numeral 38 denotes a torque convertor output shaft revolution sensor for detecting the revolution speed of the output shaft of the torque convertor with a lock-up mechanism 33.

Figure 3:
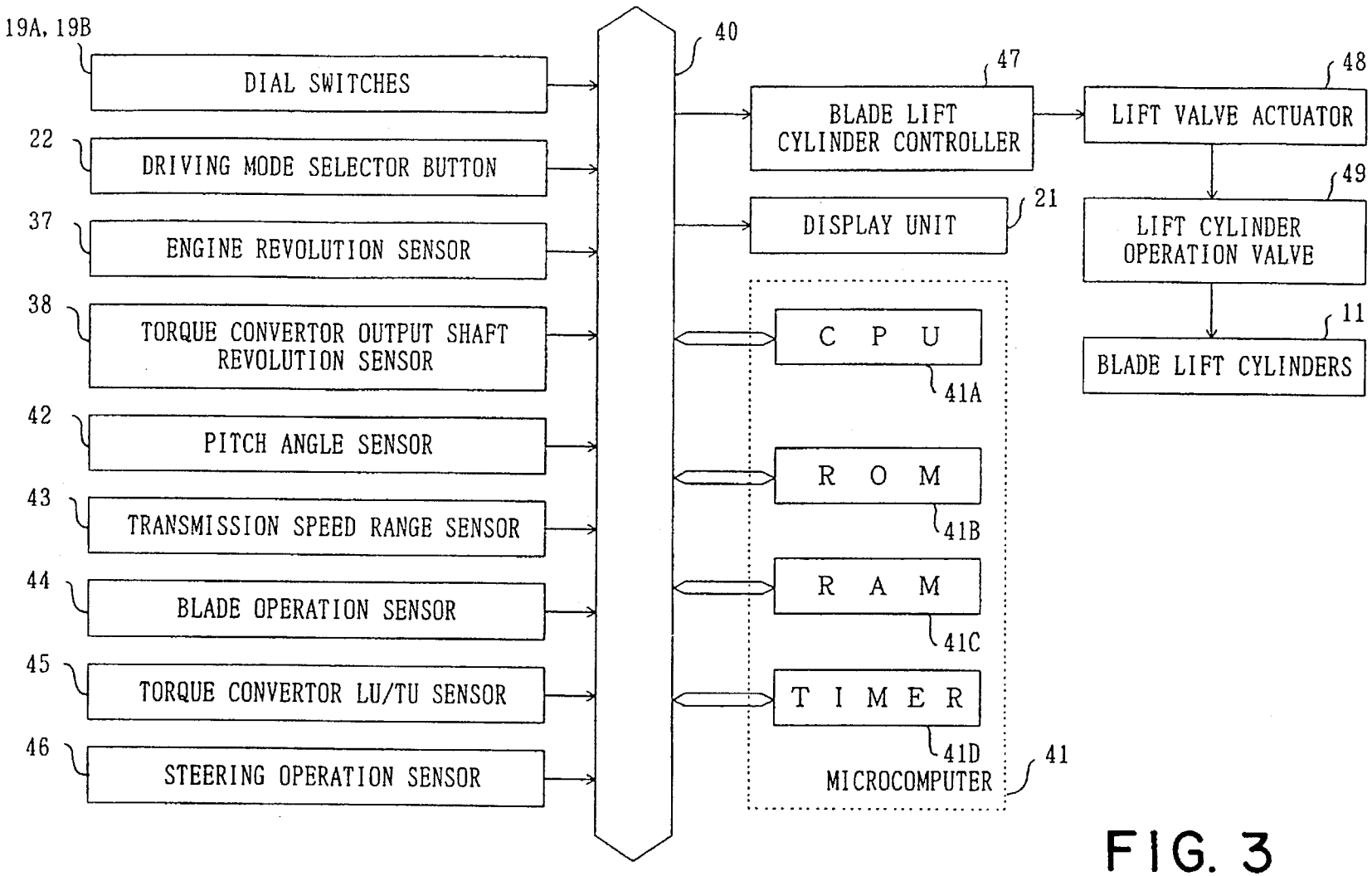

Referring to FIG. 3 which schematically shows the overall construction of the load control unit for a bulldozer of the invention, the following data items are supplied to a microcomputer 41 through a bus 40: (i) dial value data sent from the first dial switch 19A, regarding the magnitude of a load applied to the blade 7, which load is set by the first dial switch 19A; (ii) dial value data sent from the second dial switch 19B, regarding a correction value to be added to or subtracted from the set load; (iii) data on the pressing operation condition of the driving mode selector button 22 for switching between the manual operation mode, automatic digging mode or automatic carrying mode and so on in dozing operation; (iv) revolution speed data from the engine revolution sensor 37, regarding the revolution speed of the engine 30; and (v) revolution speed data from the torque convertor output shaft revolution sensor 38, regarding the revolution speed of the output shaft of the torque convertor 33. The following data and so on are also supplied to the microcomputer 41 through the bus 40: (i) pitch angle data sent from a pitch angle sensor 42 that detects the momentarily varying pitch angle of the vehicle body 2 inclining in forward and backward directions; (ii) data from a transmission speed range sensor 43 that detects the speed range selecting condition of the transmission 34 on selecting speed ranges by operating the transmission shift lever 16; (iii) data from a blade operation sensor 44 that detects whether or not the blade 7 is manually operated by the blade control lever 18; (iv) data from a torque convertor LU/TC sensor 45 that detects the lock-up (LU)/torque converting (TC) changing condition of the torque converter 33 on switching lock-up (LU) state, these conditions being switched by switching the lock-up state of the torque convertor 33 with the lock-up selector switch 20; and (v) data from a steering operation sensor 46 that detects whether or not the steering is in operation.

The microcomputer 41 is composed of a central processing unit (CPU) 41A for executing a specified program; a read only memory (ROM) 41B for storing the above program and various maps such as a curved engine characteristic map and curved torque convertor characteristic map; a random access memory (RAM) 41C serving as a working memory necessary for executing the program and as registers for various data; and a timer 41D for measuring elapsed time for an event in the program. The program is executed in accordance with (i) the dial value data on the set load to be applied to the blade 7; (ii) the dial value data on the correction value to be added to or subtracted from the set load; (iii) the data on the pressing operation condition of the driving mode selector button 22; (iv) the data on the revolution speed of the engine 30; (v) the data on the revolution speed of the output shaft of the torque convertor 33; (vi) the data on the pitch angle of the vehicle body 2 in forward and backward directions; (vii) the data on the speed range selecting condition of the transmission 34; (viii) data on whether or not the blade 7 is in manual operation; (ix) data on the lock-up (LU)/torque converting (TC) changing condition of the torque converter 33; and (x) data on whether or not the steering is in operation. Then, data on the lift operation amount for lifting or lowering the blade 7 is supplied to a blade lift cylinder controller 47, and the right and left blade lift cylinders 11 are driven based on the lift operation amount by means of the controller 47 with the help of a lift valve actuator 48 and a lift cylinder operation valve 49, whereby the blade 7 is lifted or lowered. The display unit 21 displays information such as whether the bulldozer 1 is presently in the manual operation mode, automatic digging mode or automatic carrying mode and so on in dozing operation.

Figure 4A:
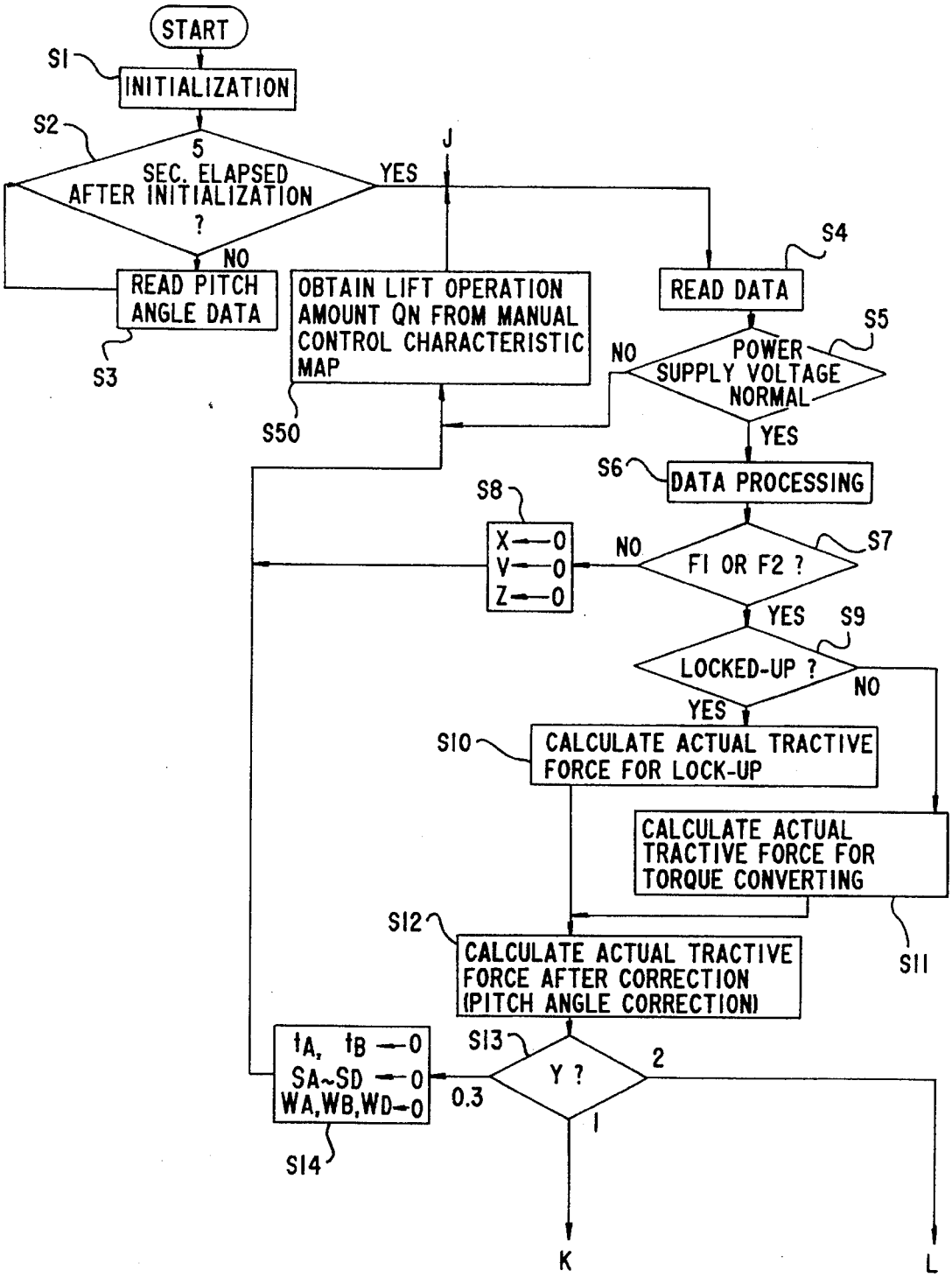
FIGS. 4A, 4B and 4C show is a flowchart of a dozing program.
Figure 4B:
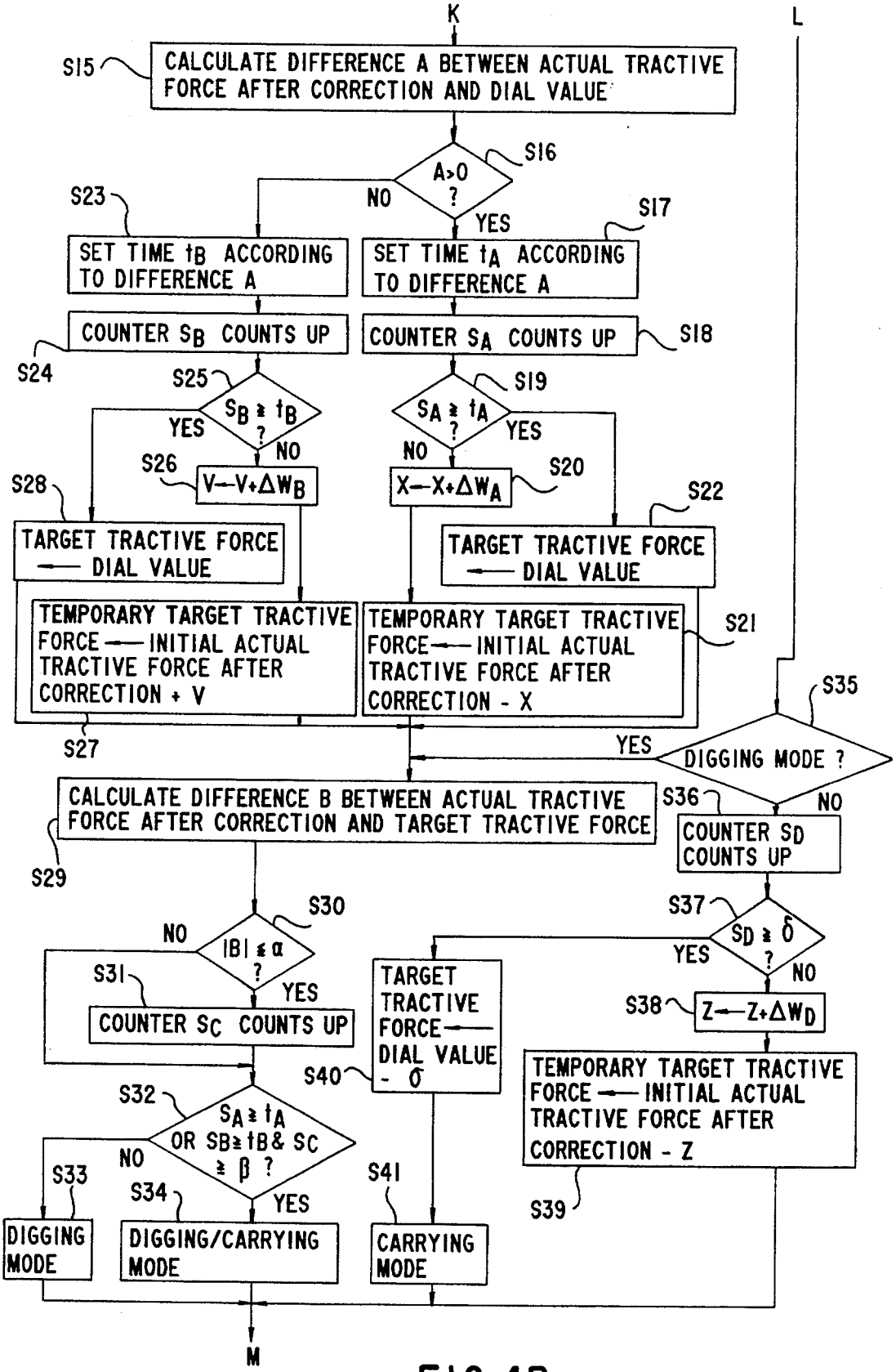
Figure 4C:
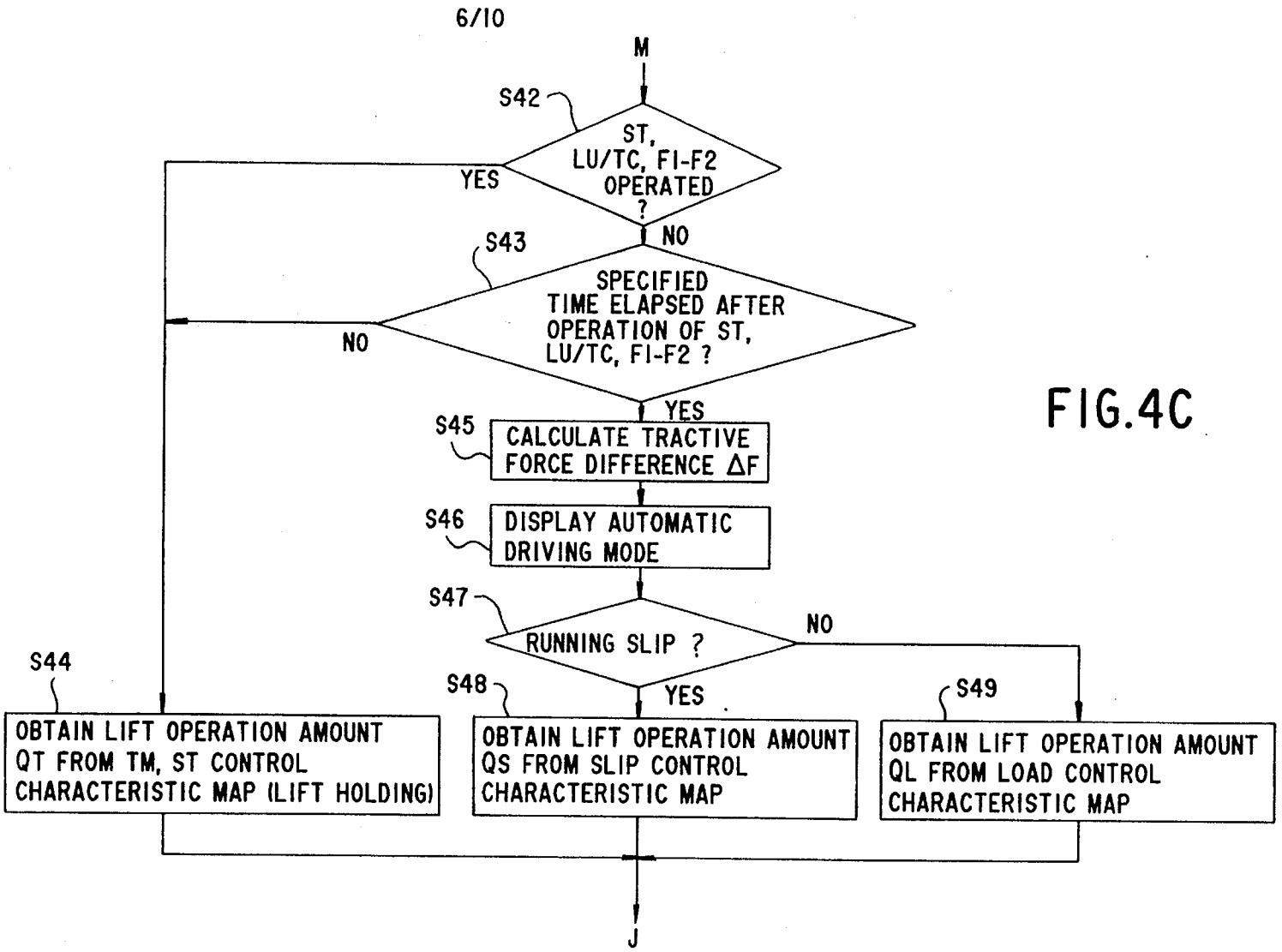

Now reference is made to the flowchart of FIGS. 4A, 4B, 4C for describing, in detail, the performance of the load control unit for a bulldozer having the above-described construction.

Step 1 to Step 3: Power is loaded to start execution of the specified program and to execute initialization by clearing all the data of the registers and so on in the RAM 41C of the microcomputer 41. For a specified time (5 seconds in this embodiment) after the initialization, pitch angle data are sequentially read from the pitch angle sensor 42 as initial values. The reason why pitch angle data are sequentially read as initial values is that the pitch angle of the vehicle body 2 is obtained by frequency separation using the moving average of the pitch angle data.

Step 4 to Step 6: The following data are firstly read: (i) the dial value data sent from the first dial switch 19A, regarding a set load to be applied to the blade 7; (ii) the dial value data sent from the second dial switch 19B, regarding a correction value to be added to or subtracted from the set load; (iii) the data from the driving mode selector button 22, regarding the pressing operation condition; (iv) the data from the engine revolution sensor 37, regarding the revolution speed of the engine 30; (v) the data from the torque convertor output shaft revolution sensor 38, regarding the revolution speed of the output shaft of the torque convertor 33; (vi) the data from the pitch angle sensor 42, regarding the pitch angle of the vehicle body 2 in forward and backward directions; (vii) the data from the transmission speed range sensor 43, regarding the speed range selecting condition of the transmission 34; (viii) the data from the blade operation sensor 44, regarding whether or not the blade 7 is in manual operation; (ix) the data from the torque LU/TC sensor 45, regarding the lock-up (LU)/torque converting (TC) condition of the torque converter 33; and (x) the data from the steering operation sensor 46, regarding whether or not the steering is in operation. Then, if the voltage of the power source is normal, i.e., more than a specified value and the electronic circuit and so on is in a normal driving condition, the following data processing is executed.

1. Low frequency components are derived from the sequentially read pitch angle data by frequency separation, utilizing the method of moving averages, whereby the pitch angle of the vehicle body 2 is obtained.
2. Then, acceleration components are derived by frequency separation, specifically, by subtracting the above low frequency components from the pitch angle data sequentially read, whereby the acceleration of the vehicle body 2 is obtained.

Step 7 to Step 12: When the speed range selected in the transmission 34 is the first forward speed (F1) or the second forward speed (F2), an actual tractive force $F_R$ is calculated in either of the following methods selected depending on whether the torque converter 33 is in the state of "locked-up" or "torque converting".

1. "Locked-up"

Figure 5:
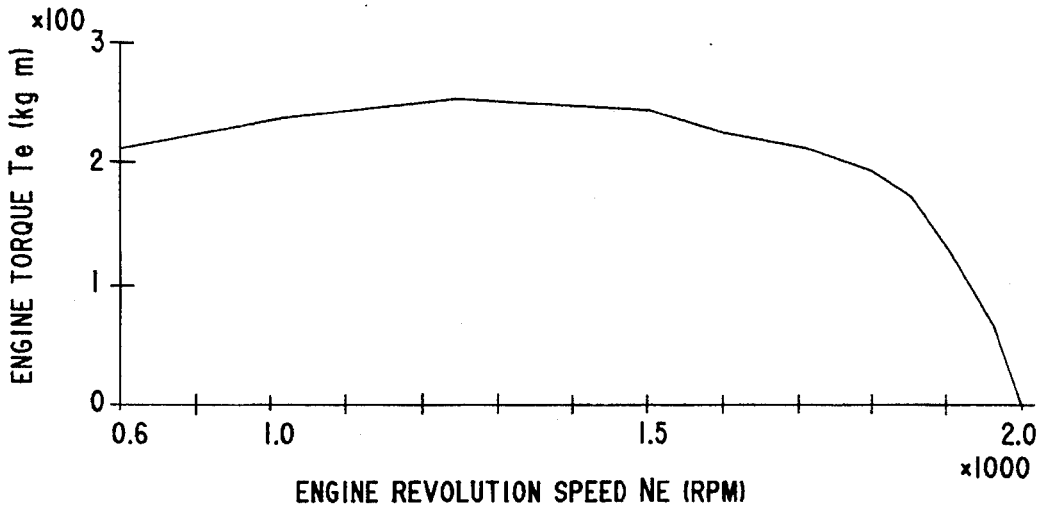
Figure 6:
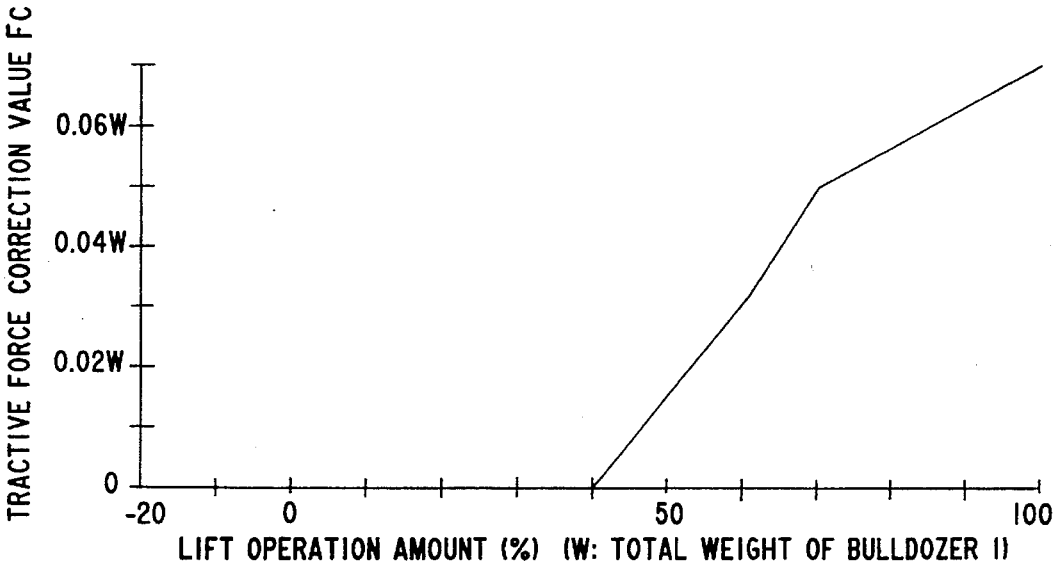

Engine torque Te is obtained from the curved engine characteristic map as shown in FIG. 5, using the revolution speed Ne of the engine 30. Then, the engine torque Te is multiplied by a reduction ratio $k_{se}$ provided over the range of the transmission 34, the steering mechanism 35 and the final reduction mechanisms 36 (in other words, the reduction ratio between the output shaft of the torque convertor 33 and the sprockets 6) and further multiplied by the diameter r of the sprocket 6, to thereby obtain a tractive force Fe ($=Te\times k_{se}\times r$). A tractive force correction value Fc is subtracted from the tractive force Fe, thereby obtaining an actual tractive force $F_R$ ($=Fe-Fc$). The tractive force correction value Fc corresponds to the consumption amount of the hydraulic pumps including operation pumps working on the blade lift cylinders 11 and so on in the PTO 32, and can be obtained from the pump correction characteristic map as shown in FIG. 6, using the lift operation amount of the blade 7.

2. "Torque converting"

Figure 7:
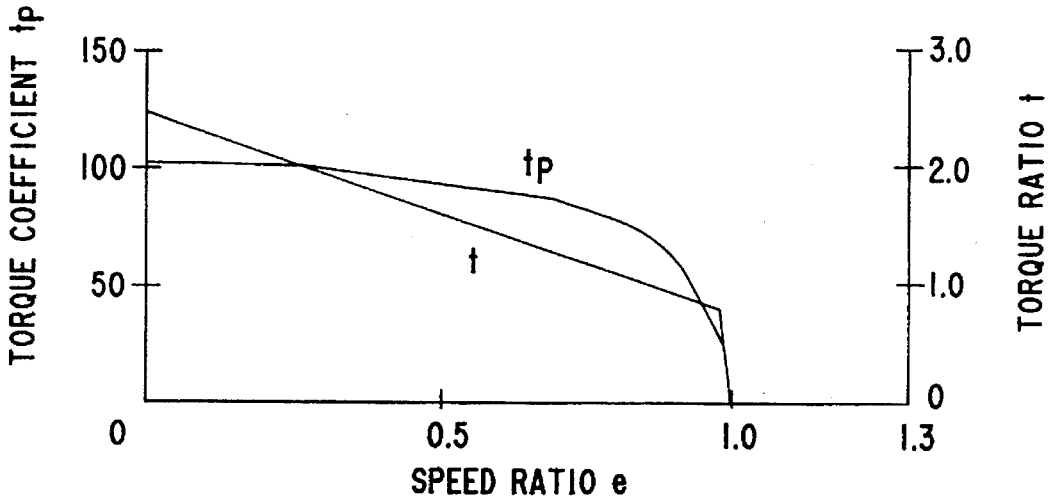

A torque coefficient $t_p$ and torque ratio t are obtained from the curved torque convertor characteristic map as shown in FIG. 7, using the speed ratio e ($=Nt/Ne$) that is the ratio of the revolution speed Ne of the engine 30 to the revolution speed Nt of the output shaft of the torque convertor 33, and then torque convertor output torque Tc ($=t_p\times(Ne/1000)^2\times t$) is obtained. Like the case 1, the torque convertor output torque Tc is multiplied by the reduction ratio $k_{se}$ between the output shaft of the torque convertor 33 and the sprockets 6 and further multiplied by the diameter r of the sprocket 6, to thereby obtain an actual tractive force $F_R$ ($-Tc\times k_{se}\times r$).

Figure 8:
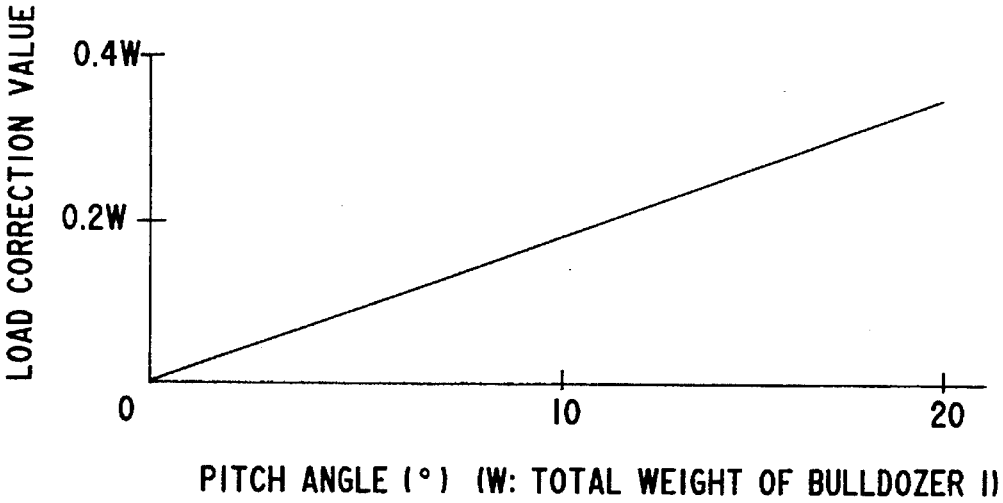

A load correction value, which corresponds to the pitch angle of the vehicle body 2 and can be obtained from the pitch angle-load correction value characteristic map as shown in FIG. 8, is subtracted from the actual tractive force $F_R$ thus obtained, thereby obtaining an actual tractive force after correction F.

If the speed range selected by the transmission 34 is neither the first forward speed (F1) nor the second forward speed (F2), cumulative values X, Y and Z which are used for calculation are set to "0" so that the actual tractive force gradually comes closer to a target tractive force which corresponds to the dial value set by the first dial switch 19A for determining the magnitude of a load on the blade 7 when the automatic digging mode is selected.

Step 13 to Step 28: If the number of pressing operations Y of the driving mode selector button 22 is 0 or 3, it is determined that the manual operation mode is selected and counters $s_A$, $s_B$, $s_C$, $s_D$ (to be described later), timers $t_A$, $t_B$, and the values of unit tractive force components $\Delta W_A$, $\Delta W_B$, $\Delta W_D$ etc. are reset.

If the number of pressing operations Y of the driving mode selector button 22 is 1, it is determined that the automatic digging mode is selected and the following process is taken.

The difference A between an initial actual tractive force after correction F' at the time digging is started with the automatic digging mode and a dial value set by the first dial switch 19A and corresponding to a load to be applied to the blade 7 is calculated. A target tractive force $F_0$ is obtained through either of the following processes selected depending on whether A>0 or A≦0, in other words, whether or not the initial actual tractive force after correction F' exceeds the dial value. Time spent in repeatedly executing the routine program is 20 m seconds in this embodiment.

Figure 9:
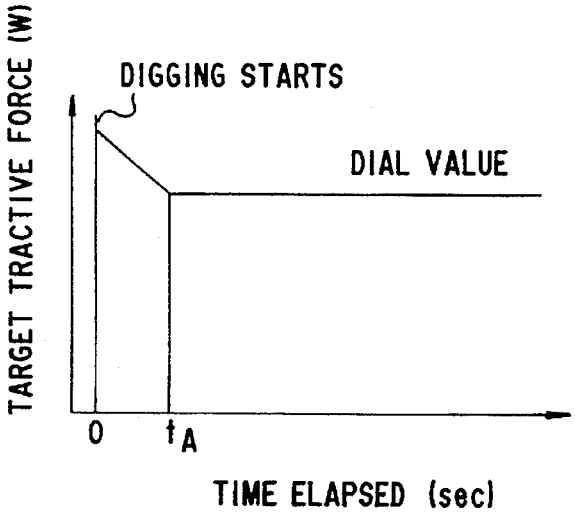

(I) If the initial actual tractive force after correction F' exceeds the dial value (see FIG. 9):

Time $t_A$ is set in accordance with the degree of the difference A (e.g., $t_A$=A×15). The value of counter $s_A$ for counting the elapse of the time $t_A$ is incremented by 1. Then, either of the following processes is taken according to whether the value of the counter $s_A$ has reached the time $t_A$.

(i) If the value of the counter $s_A$ has not reached the time $t_A$:

A temporary target tractive force $F_0$ with which the actual tractive force becomes closer to the dial value each time the program is executed is obtained from the following calculation, based on the cumulative value X of the unit tractive force components $\Delta W_A$ which are set according to the value of the counter $s_A$.

The temporary target tractive force $F_0$←the initial actual tractive force after correction F'—the cumulative value X (ii) If the value of the counter $s_A$ has reached the time $t_A$: The target tractive force $F_0$ is set to the dial value.

Figure 10:
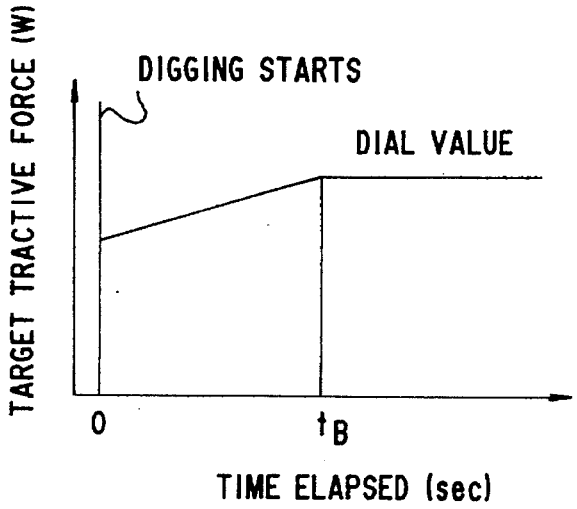

(II) If the initial actual tractive force after correction F' is less than the dial value (see FIG. 10):

Time $t_B$ is set according to the degree of the difference A and the value of counter $s_B$ for counting the elapse of the time $t_B$ is incremented by 1. Either of the following processes is taken depending on whether the value of the counter $s_B$ has reached the time $t_B$. In order to prevent a load abruptly applied to the blade 7, time required for making the actual tractive force to be equal to the dial value when the initial actual tractive force after correction F' is smaller than the dial value is made longer than that when the initial actual tractive force after correction F' is greater than the dial value (e.g., $t_B$=A×60).

(i) If the value of the counter $s_B$ has not reached the time $t_B$:

A temporary target tractive force $F_0$ with which the actual tractive force becomes closer to the dial value each time the program is executed is obtained from the following calculation, based on the cumulative value V of the unit tractive force components $\Delta W_B$ which are set according to the value of the counter $s_B$.

The temporary target tractive force $F_0$←the initial actual tractive force after correction F'+the cumulative value V (ii) If the value of the counter $s_B$ has reached the time $t_B$: The target tractive force $F_0$ is set to the dial value.

Step 29 to Step 34: After the actual tractive force has reached the target tractive force $F_0$ (dial value) by the calculation in each step, the following process is taken in order to smoothly perform switching from the automatic digging mode to an automatic digging/carrying mode. The automatic digging/carrying mode mentioned herein is a driving mode with which the lifting/lowering operation of the blade 7 is scarcely carried out when the actual tractive force is substantially equal to the target tractive force in the automatic digging mode, and with which digging and carrying are both carried out stably.

Firstly, the difference B between the actual tractive force after correction and the target tractive force $F_0$ is calculated. If the absolute value (|B|) of the difference B is within a minute value α(=±0.05 W (W: total weight of the bulldozer 1) in, this embodiment), the counter $s_C$ for counting the number of times that |B| is within the minute value α counts up. Then, if the value of the counter $s_A$ has reached the time $t_A$, or if the value of the counter $s_B$ has reached the time $t_B$ and the value of the counter $s_C$ is equal to a specified value β (=50 in this embodiment), it is judged that the automatic digging mode has been shifted to the automatic digging/carrying mode. On the other hand, if the condition represented by $s_A \geqq t_A$ or the condition represented by $s_B \geqq t_B$ and $s_C \geqq \beta$ is not met, it is judged that the bulldozer 1 is still in the automatic digging mode.

Step 35 to Step 41: If the number of pressing operations of the driving mode selector button 22 is 2, either of the following processes is taken.

(I) If the present driving mode is the automatic digging mode:

Steps from Step 29 onwards are taken until the automatic digging mode is shifted to the automatic digging/carrying mode.

Figure 11:
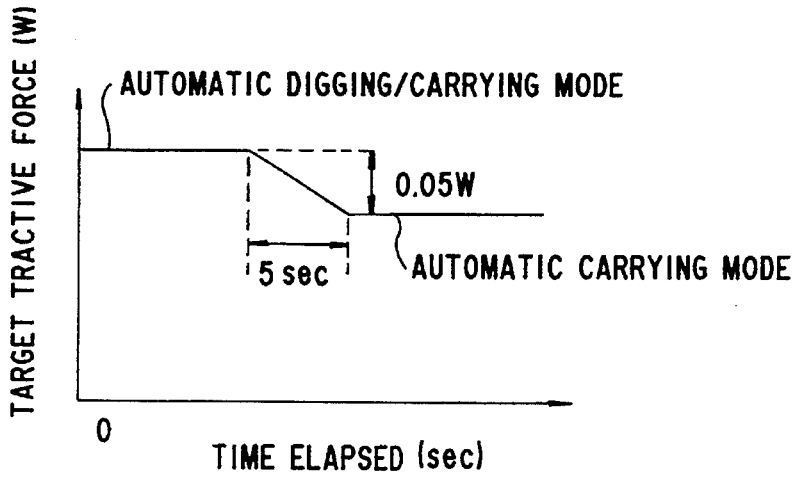

(II) If the present driving mode is not the automatic digging mode i.e., if the automatic digging mode has been already shifted to the automatic digging/carrying mode (see FIG. 11):

The counter $s_D$ for counting the elapse of time required for gradually switching to the automatic carrying mode counts up. Then, if the value of the counter $s_D$ is less than a specified value γ (=250 in this embodiment), a temporary target tractive force $F_0$, with which the actual tractive force becomes closer to the target tractive force for the automatic digging/carrying mode each time the program is executed, is obtained from the following calculation, based on the cumulative value Z of the unit tractive force components $\Delta W_D$ which are set in accordance with the value of the counter $s_D$.

The temporary target tractive force $F_0$←the initial actual tractive force after correction F'—the cumulative value Z On the other hand, if the value of the counter $s_D$ has reached the specified value γ (=250), the value obtained by subtracting a specified value δ (=0.05 W in this embodiment) from the dial value is set as the target tractive force and it is judged that the automatic digging/carrying mode has been shifted to the automatic=carrying mode.

Step 42 to Step 44: When the steering (ST) is in operation, when the torque convertor 33 is in an LC/TC switched state where the locked-up (LC) state is being switched to the torque converting (TC) state or vice versa, or when the speed range is being shifted by the transmission (TM) 34 from the first forward speed (F1) to the second forward speed (F2) or vice versa, there is a likelihood that the actual tractive force cannot be correctly calculated, therefore causing erroneous operation of the blade 7. In order to avoid such a problem, a lift operation amount $Q_T$ for holding the blade 7 is obtained from a TM/ST control characteristic map (not shown). Likewise, when a predetermined time has not elapsed after the operation of the steering (ST), when a predetermined time has not elapsed after switching between the locked-up (LU) state and the torque converting (TC) state, or when a predetermined time has not elapsed after shift between the speed ranges by the transmission 34, the lift operation amount $Q_T$ for holding the blade 7 is obtained. In the foregoing embodiment, the predetermined time after the operation of the steering is set to 2 seconds. As to the predetermined time after switching between the locked-up (LC) state and torque converting (TC) state, it is set to 0.5 second in the case of LU→TC and to 2 seconds in the case of TC→LU. The predetermined time after shift between the speed ranges by the transmission 34 is 0.5 second.

Step 45 to Step 46: When the steering (ST) is not operated, when neither switching between the locked-up (LU) state and torque converting (TC) state nor shift between the speed ranges by the transmission (TM) 34 is carried out, and when the predetermined time has already elapsed in each case described above, the difference ΔF between the target tractive force and the actual tractive force after correction is obtained and the display unit 21 indicates the driving mode of dozing operation, i.e., the manual operation mode, automatic digging mode or automatic carrying mode.

Step 47 to Step 49: The shoe slip (i.e., running slip) of the vehicle body 2 is detected as "running slip", based on the following conditions, from moving average acceleration and the actual tractive force after correction F. The moving average acceleration is obtained by applying the method of moving averages to the acceleration of the vehicle body 2 which has been obtained from the acceleration components derived from the pitch angle data by frequency separation.

1. If either of the following conditions is satisfied, the occurrence of running slip is admitted.
   (1°≈0.0174 G)
   (1) the moving average acceleration $\epsilon<-4°$ or
   (2) the moving average acceleration $\epsilon<-2°$ and the actual tractive force after correction F>0.6 W
2. If either of the following conditions is satisfied, it is admitted that running slip has stopped after occurrence.
   (1) the moving average acceleration $\epsilon>0.1°$ or
   (2) the actual tractive force after correction F>the actual tractive force after correction at the start of running slip F−0.1 W After judging whether or not running slip has occurred based on the foregoing conditions, either of the following steps will be taken in accordance with the judgment.

Figure 12:
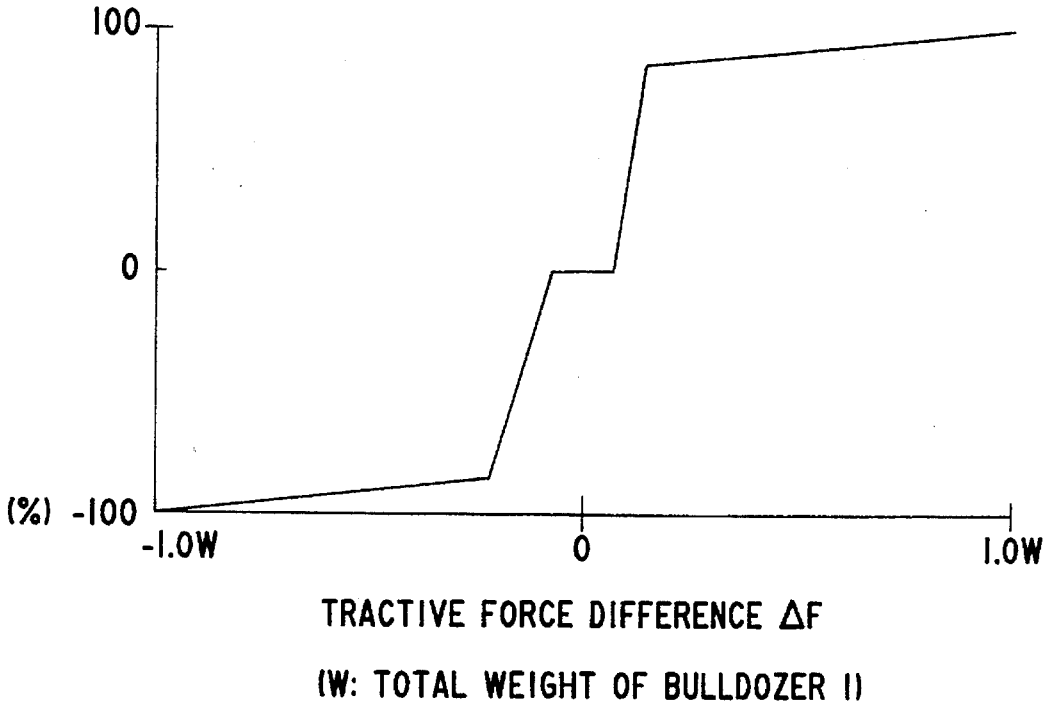

1. If it is judged that running slip has occurred, a lift operation amount $Q_S$ for lifting the blade 7 is obtained from a slip control characteristic map (not shown) in order to eliminate the running slip by reducing the load applied to the blade 7.
2. If it is judged that no running slip has been detected, a lift operation amount $Q_L$ for lifting or lowering the blade 7 such that the actual tractive force after correction F becomes equal to the target tractive force $F_0$ is obtained from a load control characteristic map shown in FIG. 12, using the tractive force difference ΔF between the target tractive force $F_0$ and the actual tractive force after correction F.

When the voltage of the power source is not normal, being less than the specified value and the electronic circuit and so on functions being abnormal; when the transmission 34 is in other gear conditions than the first forward speed (F1) and the second forward speed (F2); or when the manual operation mode is selected, a lift operation amount $Q_N$ for lifting or lowering the blade 7 is obtained from a manual control characteristic map (not shown), according to the operation amount of the blade control lever 18 in Step 50.

The data on the above-mentioned lift operation amounts $Q_S$, $Q_L$, $Q_T$ and $Q_N$ are supplied to the blade lift cylinder controller 47 which actuates the blade lift cylinders 11 through the lift valve actuator 48 and the lift cylinder operation valve 49 in accordance with the lift operation amounts $Q_S$, $Q_L$, $Q_T$ and $Q_N$, thereby performing the desired control of lifting or lowering the blade 7.

In the foregoing embodiment, the shift from the target tractive force at the start of digging to the dial value (see FIGS. 9 and 10) and the shift from the target tractive force for the automatic digging/carrying mode to the target tractive force for the automatic carrying mode (see FIG. 11) are carried out according to linear patterns, but it is also possible that the target tractive force is increased according to a curved pattern which rounds out upwardly and decreased according to a curved pattern which rounds out downwardly, whereby the shifts can be smoothly performed.

Although the actual tractive force is obtained by calculation when it is detected in the embodiment, the actual tractive force could be obtained by the amount of driving torque detected by a driving torque sensor for detecting the driving torque of the sprockets 6. Another alternative is that the actual tractive force is obtained based on the magnitude of bending stress detected by a bending stress sensor for detecting bending stress that is exerted on the trunnions 10 by the straight frames 8 for supporting the blade 7.

In the foregoing embodiment, the invention has been particularly described with the power transmission system equipped with the torque convertor 33 having a lock-up mechanism, but the invention is not necessarily limited to this as it may be applied to cases where a torque convertor having no lock-up mechanism or a direct transmission having no torque convertor is employed. When such a direct transmission is employed, the actual tractive force is calculated in the same way as described in the case of "locked-up" in the foregoing embodiment.

Further, in the embodiment, the running slip of the vehicle body 2 is detected by deriving acceleration components by frequency separation from the pitch angle data output from the pitch angle sensor 42, but it may be detected from an output from an independent acceleration sensor, the output indicating the accelerated condition of the vehicle body 2. Alternatively, a Doppler speed meter may be employed and the running slip is detected by comparing the actual speed of the vehicle body 2 measured by the Doppler speed meter with the traveling speed of the crawler belts 5 used for running the vehicle body 2.

In the above embodiment, there are provided a pair of dial switches 19A and 19B for setting and correcting a load to be applied to the blade 7 when the automatic digging mode is selected, and for setting a load to be applied to the blade 7 at the time of the automatic carrying mode, the specified value δ is subtracted from the set load for the automatic digging mode and after the value thus obtained is corrected by addition or subtraction, the corrected value is automatically set. However, another pair of dial switches may be provided for the automatic carrying mode. Alternatively, there may be provided a pair of dial switches for setting and correcting a load to be applied to the blade 7 when the automatic carrying mode is selected, and the load on the blade 7 for the automatic carrying mode is set through the use of these dial switches and after adding the specified value δ to the above set load, the load may be automatically set as the load on the blade 7 for the automatic digging mode. Instead of the dial switches 19A and 19B, ten key switches may be employed. In such a case, it is desirable to display the loads set by the ten key switches on the display unit 21.

It is possible in the embodiment that the first dial switch 19A is used as a soil property mode switch for selecting the property of soil to be dug such as, for example, sandy soil, gravel soil or soft rock and the load to be applied to the blade 7 is set in accordance with the selected soil property mode.

Further, in the embodiment, the set magnitude of a load on the blade 7 may be possibly increased or decreased by learning function such as to obtain an optimum frequency for the running slip (shoe slip) of the vehicle body 2 of the bulldozer 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A load control unit for a bulldozer, comprising:

(a) an actual tractive force detector means for detecting an actual tractive force of a vehicle body;

(b) a target tractive force setting means for setting a target tractive force for an automatic bulldozer blade control mode in dozing operation; and (c) blade controller means, operably coupled to said actual tractive force detector means and to said target tractive force setting means, for controlling a bulldozer blade, when dozing to commence digging is started in the automatic blade control mode and while such digging continues, for lifting said blade when the actual tractive force detected by the actual tractive force detector means is higher than the target tractive force set by the target tractive force setting means and for lowering said blade when the actual tractive force detected by the actual tractive force detector means is lower than the target tractive force so that the actual tractive force gradually and incrementally comes closer to the target tractive force, while said blade is being lifted or lowered, from the time digging by said blade is started.

2. The load control unit for the bulldozer as claimed in claim 1, further comprising driving mode switching means which performs switching between a manual operation mode and the automatic bulldozer blade control mode in dozing operation.

3. The load control unit for the bulldozer as claimed in claim 1 or 2, wherein there are provided, as the automatic bulldozer blade control mode, at least an automatic digging mode associated with digging in dozing operation and an automatic carrying mode associated with carrying in dozing operation.

4. The load control unit for the bulldozer as claimed in claim 2, wherein the driving mode switching means comprises one of a push button selector switch, a grip-type selector switch, a twisting-type selector switch and a rotary selector switch.

5. A load control unit for a bulldozer, comprising:

(a) actual tractive force detector means for detecting an actual tractive force of a vehicle body;

(b) target tractive force setting means for setting a target tractive force for an automatic blade control mode in dozing operation; and (c) blade controller means for controlling a blade to be lifted or lowered such that if there is a difference between the actual tractive force detected by the actual tractive force detector means and the target tractive force set by the target tractive force setting means when digging is started with the automatic blade control mode in dozing operation, the actual tractive force gradually comes closer to the target tractive force, wherein the blade controller means controls the blade such that when the actual tractive force at the start of digging is smaller than the target tractive force, time required for making the actual tractive force to be equal to the target tractive force is longer than that when the actual tractive force at the start of digging is greater than the target tractive force.

6. A load control unit for a bulldozer, comprising:

(a) an actual tractive force detector means for detecting an actual tractive force of a vehicle body;

(b) a target tractive force setting means for setting a target tractive force for an automatic blade control mode in dozing operation;

(c) judging means for judging whether the actual tractive force detected by the actual tractive force detector means is stable without fluctuating in relation to the target tractive force set by the target tractive force setting means; and (d) a driving mode shifting means for shifting from an automatic digging mode associated with digging in a dozing operation to an automatic carrying mode associated with carrying in the dozing operation, if the judging means judges that the actual tractive force is in a stable state.

7. The load control unit for the bulldozer as claimed in claim 6, wherein the target tractive force setting means sets the target tractive force for the automatic carrying mode a predetermined amount smaller than the target tractive force for the automatic digging mode.

8. The load control unit for the bulldozer as claimed in claim 7, wherein shifting from the target tractive force for the automatic digging mode to the target tractive force for the automatic carrying mode is carried out gradually.

9. A load control unit for a bulldozer, comprising:

(a) an actual tractive force detector means for detecting an actual tractive force of a vehicle body;

(b) a blade controller means for controlling a blade to be lifted or lowered such that, if there is a difference between the actual tractive force detected by the actual tractive force detector means and a set target tractive force, the actual tractive force becomes equal to the target tractive force;

(c) a transitional state detector means for detecting whether the vehicle body is in a transitional driving state; and (d) a blade holding controller means for temporarily halting the control of the blade carried out by the blade controller means in order to hold the blade in a predetermined position for the specified time from the point of time when the transitional state detector means detects the transitional driving state.

10. The load control unit for the bulldozer as claimed in claim 9, wherein the transitional state detector means is a convertor switched state detector means for detecting whether a torque convertor is being switched between a torque converting state in which torque transmitted between an input shaft and an output shaft of the torque convertor is converted and a locked-up state in which the torque converter is locked-up so that the torque is not converted but directly transmitted, and wherein the blade holding controller means controls the blade to be held in the predetermined position if the convertor switched state detector means detects that the torque convertor is being switched or if a specified time has not elapsed after the switching between the states of the torque convertor.

11. The load control unit for the bulldozer as claimed in claim 9, wherein the transitional state detector means is a speed range shifted state detector means for detecting whether shift between a first forward speed and a second forward speed is being carried out by a transmission, and wherein the blade holding controller means controls the blade to be held in the predetermined position if the speed range switched state detector means detects that shift between the speed ranges being carried out by the transmission or if a specified time has not elapsed after the shift between the speed ranges.

12. The load control unit for the bulldozer as claimed in claim 9, wherein the transitional state detector means is a steering state detector means for detecting the condition of a steering apparatus, and wherein the blade holding controller means controls the blade to be held in the predetermined position if the steering state detector means detects that the steering apparatus is in operation or if a specified time has not elapsed after the operation of the steering apparatus.

13.[1] The load control unit for the bulldozer as claimed in claim 1, 6 or 9, wherein the actual tractive force detector means includes an engine revolution sensor for detecting the revolution speed Ne of an engine and a torque convertor output shaft revolution sensor for detecting the revolution speed Nt of an output shaft of the torque convertor, and the actual tractive force of the vehicle body is detected by such a calculation that a speed ratio e, which is the ratio of the engine revolution speed Ne detected by the engine revolution sensor to the torque convertor output shaft revolution speed Nt detected by the torque convertor output shaft revolution sensor, is first obtained; torque convertor output torque is obtained from a torque convertor characteristic of the torque convertor, using the speed ratio e; and the torque convertor output torque thus obtained is multiplied by a reduction ratio between the output shaft of the torque convertor and sprockets for driving crawler belts used for running the vehicle body.

[1] Because the Examiner had indicated in item 1, page 2 of the outstanding Action that claim 13 was improperly amended, it is presumed that the amendments to claim 13, as filed on Aug. 14, 1995, were not entered. Accordingly, the applicants hereby resubmit (now properly amended) claim 13, which includes the changes to such claim filed on Aug. 14, 1995 (except for the deletion of the dependency of claim 13 on claim 1) and additional amendments.

14. The load control unit for the bulldozer as claimed in claim 13, wherein the actual tractive force detector means further includes a pitch angle sensor for detecting a pitch angle of the vehicle body inclining in forward and backward directions, and an actual tractive force detected based on the pitch angle detected by the pitch angle sensor is corrected.

15. The load control unit for the bulldozer as claimed in claim 1, 6 or 9, wherein the actual tractive force detector means includes an engine revolution sensor used for detecting a revolution speed of an engine when a torque convertor with a lock-up mechanism is locked up or when a direct transmission is employed, and the actual tractive force of the vehicle body is detected by such a calculation that engine torque is first obtained from a torque characteristic of the engine, using the revolution speed of the engine detected by the engine revolution sensor; and then the engine torque thus obtained is multiplied by a reduction ratio between the engine and sprockets for driving crawler belts used for running the vehicle body.

16. The load control unit for the bulldozer as claimed in claim 15, wherein the actual tractive force detector means further includes a pitch angle sensor for detecting a pitch angle of the vehicle body inclining in forward and backward directions, and an actual tractive force detected based on the pitch angle detected by the pitch angle sensor is corrected.

17. The load control unit for the bulldozer as claimed in claim 1, 6 or 7, wherein the target tractive force setting means comprises a dial switch or ten key switch.

18. The load control unit for the bulldozer as claimed in any one of claims 1, 5, 9, 10, 11 or 12, wherein the lifting/lowering control of the blade by the blade controller means is not performed when the blade is manually operated, but performed when the blade is in the automatic blade control mode and a first forward speed or a second forward speed is selected.

19. The load control unit for the bulldozer as claimed in claim 1 wherein the actual tractive force detector means includes an engine revolution sensor for detecting the revolution speed Ne of an engine and a torque convertor output shaft revolution sensor for detecting the revolution speed Nt of an output shaft of the torque convertor, and the actual tractive force of the vehicle body is detected by such a calculation that a speed ration e, which is the ratio of the engine revolution speed Ne detected by the engine revolution sensor to the torque convertor output shaft revolution speed Nt detected by the torque convertor output shaft revolution sensor, is first obtained; torque convertor output torque is obtained from a torque convertor characteristic of the torque convertor, using the speed ratio e; and the torque convertor output torque thus obtained is multiplied by a reduction ratio between the output shaft of the torque convertor and sprockets for driving crawler belts used for running the vehicle body.

20. The load control unit for the bulldozer as claimed in claim 1, wherein the actual tractive force detector means includes an engine revolution sensor used for detecting a revolution speed of an engine when a torque convertor with a lock-up mechanism is locked up or when a direct transmission is employed, and the actual tractive force of the vehicle body is detected by such a calculation that engine torque is first obtained from a engine torque characteristic of the engine, using the revolution speed of the engine detected by the engine revolution sensor; and then the engine torque thus obtained is multiplied by a reduction ratio between the engine and sprockets for driving crawler belts used for running the vehicle body.

21. The load control unit for the bulldozer as claimed in claim 1, wherein the target tractive force setting means comprises a dial switch or ten key switch.

22. The load control unit for the bulldozer as claimed in claim 1, wherein the lifting/lowering control of the blade by the blade controller means is not performed when the blade is manually operated, but performed when the blade is in the automatic blade control mode and a first forward speed or a second forward speed is selected.

23. A load control unit for a bulldozer, comprising:

(a) an actual tractive force detector means for detecting an actual tractive force of a vehicle body;

(b) a target tractive force setting means for setting a target tractive force for an automatic bulldozer blade control mode in dozing operation; and (c) blade controller means, operably coupled to said actual tractive force detector means and to said target tractive force setting means, for controlling a bulldozer blade, when dozing to commence digging is started in the automatic blade control mode and while such digging continues, for lifting said blade when the actual tractive force detected by the actual tractive force detector means is higher than the target tractive force set by the target tractive force setting means and for lowering said blade when the actual tractive force detected by the actual tractive force detector means is lower than the target tractive force so that the actual tractive force gradually and incrementally comes closer to coinciding with the target tractive force when a difference exists between the actual tractive force and the target tractive force, while said blade is being lifted or lowered, from the time digging by said blade is started.

* * * * *